United States Patent [19]

Smejda

[11] 3,995,581

[45] Dec. 7, 1976

[54] PATTERNING AND BLENDING WITH LATERAL DISTRIBUTION CHANNELS AND CROSSWISE FEEDER SYSTEMS

[76] Inventor: Richard K. Smejda, P.O. Box 344, Riverside, Paterson, N.J. 07524

[22] Filed: Aug. 27, 1974

[21] Appl. No.: 501,075

[52] U.S. Cl. ..... 118/7; 101/365; 118/412; 118/429; 222/132

[51] Int. Cl.[2] ..... B05C 11/10; B41F 31/02

[58] Field of Search ..... 118/7, 266, 267, 406, 118/419, 429, DIG. 23, 211, 412, 225, 255; 101/115, 171, 211, 365; 222/132, 135, 145

[56] References Cited

UNITED STATES PATENTS

| | | | |
|---|---|---|---|
| 2,548,431 | 4/1951 | Hague | 222/145 X |
| 2,891,474 | 6/1959 | Smejda | 101/365 |
| 2,997,212 | 8/1961 | Dyer | 222/145 |
| 3,056,384 | 10/1962 | Beale et al. | 101/115 X |
| 3,175,488 | 3/1965 | Tillett et al. | 101/115 |
| 3,345,929 | 10/1967 | Oksakovsky et al. | 118/429 X |
| 3,851,798 | 12/1974 | Miller | 222/135 |

*Primary Examiner*—Mervin Stein

[57] ABSTRACT

The patterning and blending system according to this invention superimposes two or more lateral channels distributing diverse liquids over a multitude of crosswise oriented feeder chambers with the option to block the flow connection completely or to connect each feeder chamber with any or all of the distributor channels by means of a choice of variable type and calibrated connecting orifices for the predetermined combination of proportional liquid streams of constant and repeatable quality, creating either single flow or striated liquid bundles, which in any feeder are identical to preconceived pattern notations, or to blend such liquid combinations homogeneously between distribution section and application plane on a continuous basis and at a choice variable from feeder chamber to feeder chamber and from pattern to pattern, and with means to supply automatically and under pressure a number of liquids to a constant level staging area where gravity/suction forces take over to provide measured and blended flow in sufficient quantities to satisfy demand at all production speeds.

10 Claims, 5 Drawing Figures

1
2
3
4
5
7
8
9
10
11
12
13
15
16
17
18
25
26

PATTERNING AND BLENDING WITH LATERAL DISTRIBUTION CHANNELS AND CROSSWISE FEEDER SYSTEMS

This invention relates to the supply, staging, proportioning and feeding of fluid bands in variable individual and in variable total widths comprising an infinite number of combinations and variations and to guide these compositions in a controlled and repeatable manner to an application plane where they are adhering to and removed by a continuously or intermittently moving surface.

Objects of this invention are; to provide apparatus and means for multiple fluid feeding and blending of formulations in a predetermined and constant manner to diverse surfaces moving at variable speeds; to immunize the application area from pressure surges due to intermittent supply sequences which are regulated by automatic level sensors in each distributor; and to create a feeding entity separate from the distribution system but linked with a patterning system capable of proportional correlation of liquid streams. Low pressure gravity feeding from constant-level apex to the application plane relies on low height, low kinetic energy, and limited boundary interference. This gravity feed is further modified by the adherence of the contacting band of fluid compositions to the passing surface and by its speed in passing the application plane. This force of adhesion extends into the interior of each feeder chamber due to the link between surface adhesion and molecular cohesion of the feeding liquid or liquids. The fixed force of kinetic energy controlled by the positive positioning of the electrodes of the level sensors, or by floating sensors signaling an angle variation, or any other signaling device, thus combines with the variable pull through adhesion to the moving substrate to form a flexible and within limits self-adjusting supply force independent from the powers staging a fixed amount of liquid level in each distributor. This combination of pressure staging and low pressure application is a particular object of this invention. It provides adequate fluid reserves close enough to the application plane to assure constant levels at high production speeds and the low pressure in application reduces the required sealing pressure in the contact area between feeder chambers and the substrate.

A further object is to equip the apparatus and devices with calibrated measuring orifices capable to channel several liquids at constantly proportional rates into the same feeder chamber and to supply these formulated compositions in specific layers and/or strata, or to blend them thoroughly before the application area.

Another object is to securely unite the distribution system with the feeder system over the total contact area, holding it in a sandwich-frame equipped with a three-plane alignment and adjustment combination for precision guidance and and firm control in respect to the application plane.

Other objects of the invention will in part be obvious and will in part appear hereinafter. The invention accordingly comprises the process involving the several steps and the relation and order of one or more of such steps with respect to each of the others and the apparatus possessing the construction, combination of elements and arrangement of parts which are exemplified in the following detailed disclosure, and the scope of the invention which will be indicated in the claims.

For a fuller understanding of the nature and objects of the invention, reference should be had to the following detailed description taken in connection with the accompanying drawings wherein.

Figure 5:
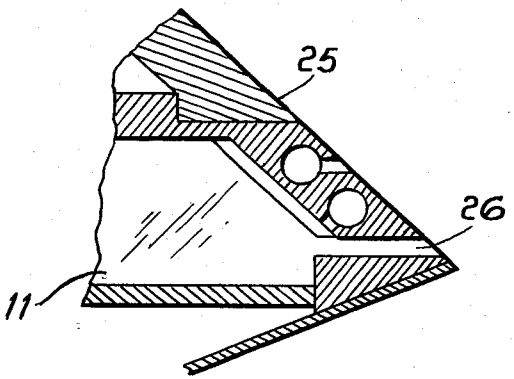
Figure 4:
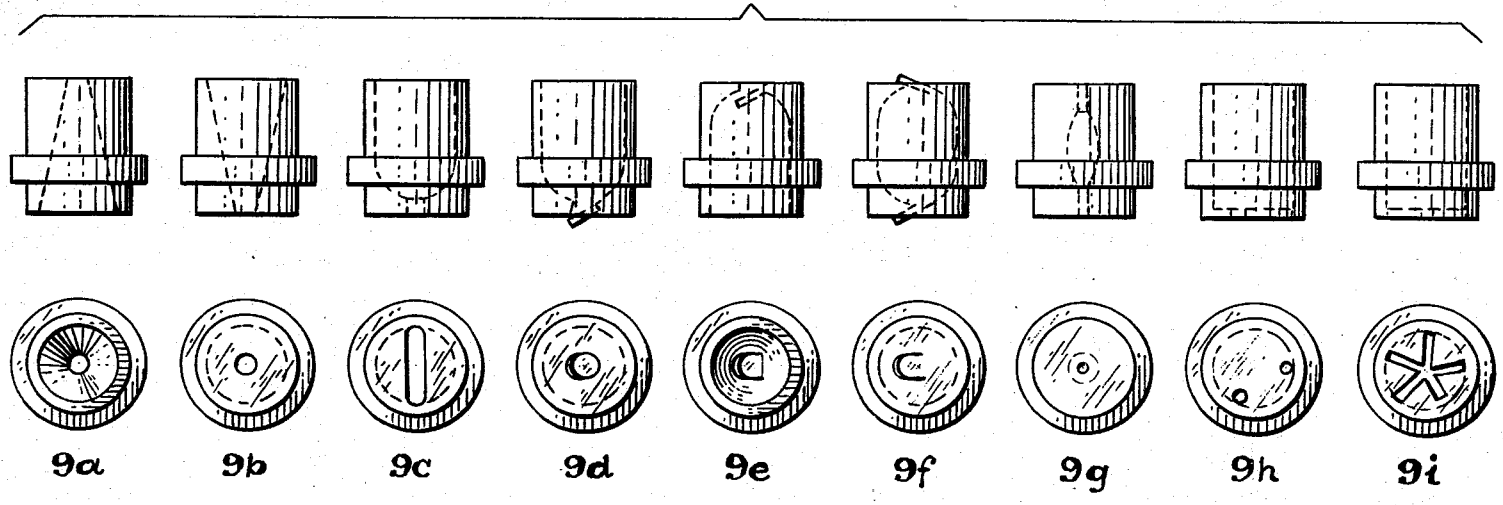

FIG. 4 demonstrates a selection of types of connecting stoppers to illustrate the scope of their functions, and FIG. 5 is a variation showing a mouth section raised above the bottom of a feeder chamber.

This invention is concerned with the supply, proportioning and spacing of multiple liquid streams feeding an application area of variable type and varying structure. It is able to supply accurate and repeatable liquid bands directly to webs, sheets, textiles, rigid or plastic materials or indirectly to carriers; embossed, engraved, or any other textured or structured surface. In textiles alone it is applicable to direct application, intaglio printing, rotary or flat screen printing, pin striping, warp dyeing and others.

Figures 1, 2:
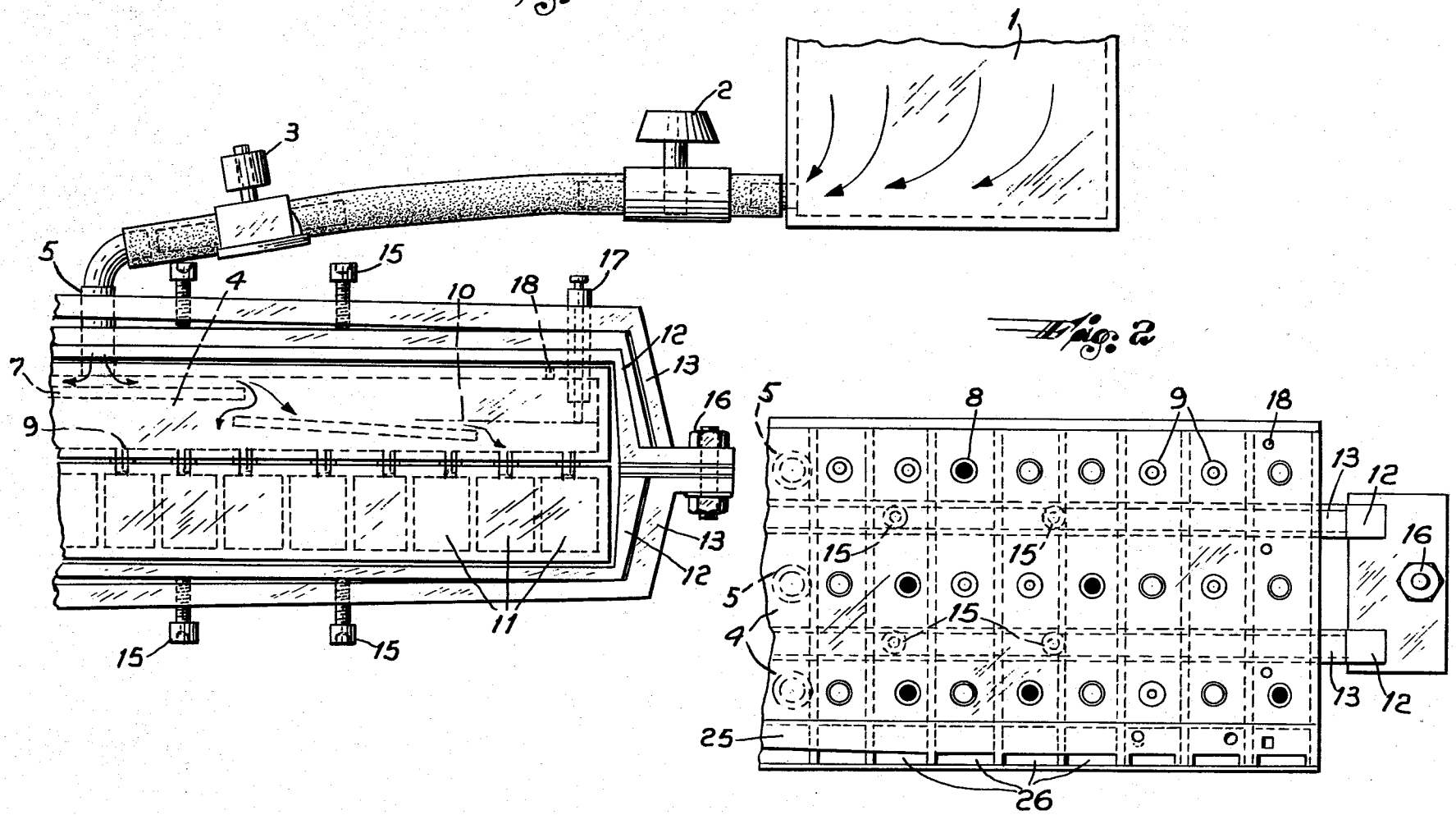
FIG. 1 is a sectional view of the supply container connected to the center of a longitudinally cut distributor and feeder assembly and compressed to a unit between the frame.
FIG. 2 is a plan view with examples of varying stopper orifices inserted to provide a combination flow of several components in many feeder chambers, the distributor is omitted for clarity of illustration.
Figure 3:
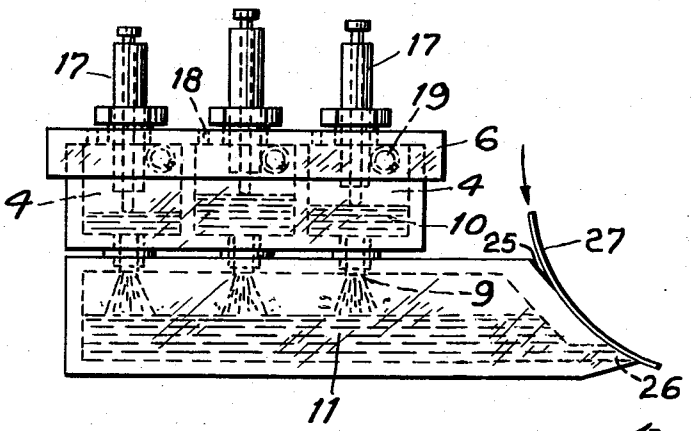
FIG. 3 is a side elevation of three distribution channels with electrodes at different levels to adjust kinetic energy and three connecting stoppers to feed a combination of all three distribution liquids into the same feeder chamber.

The procedural steps are outlined in FIG. 1 starting at right with the fluid container 1 and a supply line connected to one distribution channel 4. The flow passes the optional valve 2 to reach the remotely controlled flow gate 3, which may be a solenoid valve or pump, and is lead through a vertical supply connection 5 into the center of the distributor 4, only the right half is shown. With valve 2 open the flow is controlled by the "normally open" type solenoid valve 3. The flow continues by adjusted gravity or pump pressure on top of the center baffle 7 and divides into one left and one right branch as indicated by the arrows. The right half shown drops to a lower baffle and divides again, with the inner branch dropping to the bottom of the distributor 4 and the outer branch continuing to the extremity of baffle 7 where it also reaches the bottom of distributor 4 or drops to another baffle as warranted by the width of the system. This multiple spacing of the supply is one way of keeping the entrance pressure of the fluid supply from favouring feeder chambers 11 being connected in close proximity to such entrances. Another method is illustrated in FIG. 3 which shows pipe 19 in cross-section. Pipe 19 is extending laterally in the top of each distributor 4 with openings at small intervals facing one or both sidewalls of distributor 4. These openings are adjusted in size or distance from each other to compensate for frictional pressure losses along the length of pipe 19 in order to provide equal supply with instant surface level over the entire length of the distributor 4. In this instance the supply spouts extend from one or both lateral extremities and on very wide units intermediate connections may be added to assure even supply over the entire liquid level. Spraying the liquid supply onto the sidewalls, or onto special rims along these sidewalls of each distributor 4 reduces the supply pressure due to friction/adhesion boundary interference and eliminates the influence of pressure surges on the lower feeding chambers 11.

In the upper region of each distributor 4 and above the liquid level is at least one opening as air vent 18. It relieves building of air pressure from supply surges, which would occur in a completely closed system and prevents vacuum which would impair gravity feeding in the application area. On stopping of operations with the supply still full, vacuum is desirable to assist general sealing purposes at the mouth opening. Therefore closing means for one or all air vents 18 are installed to create a closed system in any or all distributor channels 4 as desired by operating designs. For this purpose conical closing tips at the end of a lever arrangement are activated individually for a specific design or all together at the stop of a production run to close air vents 18. Another use of the air vents 18 is their connection to a pulsating air pressure creating rhythmical pressure surges which increase penetrating pressure on their occurrence with a higher liquid deposit on permeable substrates whenever activated. Alternate pulses in several distributors 4 are additional means of patterning depth of color appearance or liquid deposit. This pulsating also causes stoppers **9*d*, 9*e* and 9*f*** to increase their discharge at this incidence.

To keep the adjusted liquid level in each distribution channel 4 constant during operation, and irrespective of sizable localized liquid withdrawal at individual locations, is a combined task of the liquid spreading arrangement explained above and the level sensors 17 controlling the supply forces. Various means are applicable; closing the solenoid valve 3 when the sensor electrode is grounded by the rise of liquid level in the distributor 4 and opening it when the ground is disconnected by a drop of the liquid level 10. Connecting the electrode impulse to a relay energizing a pump motor is another way. Using a semiconductor with graduated energy release depending on immersion of a certain depths of this electrode as sensor and connecting this staggered impulse to a rheostat and shunt wound DC-motor-pump, or in connection with one eccentric controlled hydraulic pump, complete shutoff is converted into a more gradual supply release. The choice is a matter of economics. This variety of means permits adaptation to a wide variety of applications.

The level sensors 17 are adjustable in height of penetration by the spacer ring resting on the surface of cover 6. This spacer slides or is threaded to remain at the adjusted height and sets the tip of the electrode of sensor 17 at the desired liquid level. Higher liquid level compensates for higher viscosity and creates higher kinetic energy with a resulting increased penetration into permeable substrates, the opposite is valid for lower liquid level.

The connection between each distributor channel 4 and each feeder chamber 11 is established with connecting bores located at each intersection between both systems. To modify these connections blocking stoppers 8 and connecting stoppers 9 are inserted at will (FIG. 2). Connecting stoppers 9 have been designed in a wide variety of shapes to fulfill many different functions, the major types being illustrated in FIG. 4. The top row shows a side elevation and the bottom row a corresponding plan view. The plan view of FIG. 2 shows another variable, i.e. changes in orifice dimensions being calibrated in order to provide proportional feeding of two or more distributors 4 into the same chamber 11. The blocking stoppers 8 in FIG. 2 are marked with black ink, while the various dimensions of concentrical inner rings on stoppers 9 demonstrate various orifices with differing supply capacity, the orifice sizes being calibrated and proportional to each other. Calibrated stoppers are fashioned from the basic form displayed in FIG. **4, 9*h* and 9*i*, with the membrane at the bottom being perforated in concentric proportional openings, or in any special configuration like the double pin-hole in the bottom of 9*h* or the star flap susceptible to pulsations in 9*i*. The stoppers 9 are shown in natural size for one version of application. The gap between one pinhole in a membrane 9*h* and the full elimination of this membrane in 9*h* constitutes the scope of proportions in supply in combination with liquid level and pressure pulses. As each feeder chamber 11 has one connection to each distributor 4 the feeder is capable of receiving a different proportion from each distributor adding up to a number of components equal to the number of distributors minus distributors blocked by stoppers 8. These openings calibrated in normal sizes provide the base for constant proportioning during application in compliance with predetermined liquid formulations. Taking decimal units like millimeters for standard calibration, three openings from three distributors 4 into the same feeder chamber 11 may be designed to supply an 8mm flow of yellow plus a 4mm stream of red and a 2mm trickle of blue, this combination is commonly used to prepare a brown and is here produced on a continuous basis right during operation. Three additional requirements constitute the base for constancy in this flow formulating; steadiness of feeding level, constant viscosity or energy compensation for variations, and efficient blending within each feeder chamber 11. The level sensors assure the feeding level, viscosity is checked automatically or manually during production and compensated by raising or lowering the liquid level, or by viscosity adjustment in the supply vessel 1. Blending is performed in the area between the feeder mouth 26 and the most forward row of stopper connections 8 and 9. Blending is performed with any kind of efficient agitator or vibrator inserted through an opening in the above mentioned area, which is regularly closed by an insert and reserved for the blender in case of need. Examples for blending devices are transducers of any type; ultrasonic, electromagnetic, or mechanical vibrators of high efficiency in tight places. This blending action in any particular feeder chamber 11 is assisted or replaced by insertion of grids, lattices or other minute cross-channeling devices just ahead of the mouth section to break-up and overlap striated liquid flow from the formulating section into tiny droplets which are easier homogenized by suitable application configurations in the application plane 25 adjacent feeder mouth 26 which applies liquid to a passing substrate 27.**

In FIG. 4 types of connecting stoppers 9 are sampled without going into the additional variable varying orifice size. The gravity flow through connecting stoppers 9 logically proceeds from top to bottom. Consequently, the liquid enters the first stopper **9*a* at the narrow opening on the top, which limits the entering quantity and spreads on the downward passage forming a thin layer on the liquid already present from a large connector out of another distributor channel. In other words the modifications 9*a* to 9*i* are designed to augment generally one or more larger supply sources entering the same feeder chamber 11 from other distributors and representing the liquid base to be modified in specific fashion. Stopper 9b illustrates a large opening narrowing into a small orifice which concentrates the effluent in the center of the mainstream below. Stopper 9c has a wide opening narrowing into a slot which can be directionally oriented in regard to the length of the feeder chamber 11, with the slot being parallel to the length it enters a narrow band and perpendicular to it deposits a wide film with intermediate positions giving intermediate flow characteristics. Stopper 9d has the same open supply entrance narrowing to a small orifice partially obscured by an elastic flap which reacts with an increase of opening either to suction from the feeder mouth or to a pressure wave from the distributor 4. Stopper 9e is the reverse of 9d with the flap at the top forming a narrow entrance and consequently passes a thin droplet supply only, or a pulsating trickle spread over the surface below. Stopper 9f fills intermittently and releases tiny blops on reaction to pressure cycles. Stopper 9g adds a very small fluid line in minute quantities somewhat eased by the widening in the middle which relieves boundary friction for more viscous liquids. Stopper 9h and 9i have been explained along with proportional feeding; 9h is a directionally orientable pinhole arrangement with two pin orifices, 9i** has a star opening stamped into an elastic membrane and reacts to pressure waves within the liquid stream.

It is a standard feature of this invention to feed by gravity from a constant and adjusted level in the distributors 4 to the feeder chambers 11 below. Within this norm many configurations are feasible to suit a particular mode of application. For example the application plane may be moved to any part of a modified feeder section not conflicting with the orifice connections to the distributor system. This is upwards in front or anywhere underneath the feeder chambers. It leads to another version with the mouth section 26 at a higher level than the bottom of the feeder chambers 11 as shown in FIG. 5, with an upward flow from each feeder chamber to the corresponding mouth segment, which in any case has to be just below the liquid level, just enough to reduce kinetic energy exerted by the gravity-flow-system of the distributor/feeder assembly. This upward channel also provides an ideal location for the insertion of blenders fitting into each channel individually at choice.

Another modification of the distributor/feeder assembly is the general reduction of cross-sectional width and a corresponding increase in height of each distributor 4, with the feeder chambers 11 below having their mouth section 26 transferred into the area below the feeder chambers in order to achieve a more circular cross-section of the total assembly fitting into cylindrical screens, as for example rotary screen printing machines. One example of a mouth configuration according to this modification is illustrated in the inventors U.S. Pat. No. 2,887,044, FIGS. 1 and 2.

A very important feature of this invention is the structural reinforcement and regulative potential of the total system within itself and in regard to the application area.

The distributor system 4 and the feeder chambers which are preferably constructed with plastic materials, have to be held together with great force in order to assure sealing contact over their interfaces joined by the stoppers 8 and 9. Some deflection of the sandwiched feeder/distributor system is occasionally required to meet the crown or deflection of the carrier arrangement composing the application area. This requires means to provide an adjustable total deflection fitting the application system of any particular procedure. An additional feature is the regulative set-up to guide the feeder distributor assembly into adjustable contact pressure with the application area and the substrate or carrier. A three-plane adjustment is added to adjust misalignment in lateral contact using for example a screw arrangement for raising or lowering one lateral extremity and fixing this position once correction is achieved. Of equal importance are means to adjust the application mouth 26 in order to permit emphasis of contact with the application plane to be centered either on the sealing lip of the entrance side of the substrate or carrier, or the exit side, or in-between the establishment of complete congruity between feeding mouth and application plane. This angular adjustment of the total feeding system being exerted on a radial lever attached to the system with means to raise or lower this lever and with it the system, or to give it an angular twist with a turn around its lateral axis, suitable means are added to fix this adjustment in the regulated position; positioning screws, hydraulic systems or brake pressure are employed as warranted. The structural unity of distributor system and feeder system is enforced by one upper and one lower steel bridge, shown in the right half section in FIG. 1. Each bridge consists of at least two flat steel bars, which are joined firmly at their extremities 16. These extremities also carry the means for a three-plane alignment described above but not illustrated. At suitable distances over the extension of the lower and upper bridge bar 13 adjustment, screws 15 are threaded through the bar 13 to exert laterally adjustable pressure on the inner bar or bars 12. The center screws are usually made to protrude farther which deflects the otherwise straight bar 12 in the center downward or upward respectively. Both bridges 12 represent two concave surfaces towards each other as long as their extremities are not forced together with the distributor/feeder arrangement as a sandwich. As force is applied to bring the lateral axes at 16 together, the concave centers of the bars 12 begin the contact with the lateral center of the distributor/feeder assembly joining both firmly at the center to the point where the elastic stoppers 8 and 9 resist further compression at their rims, with the circular rims forming seal and buffer between the two systems. As the force at 16 continues, the concave centers are gradually flattened and the bars 12 straighten out until the total sandwich area is under equal sealing compression and the distributor/feeder assembly is joined into one strong and rugged unit. This pressure has been tried in pilot operations and may reach several tons. The concave curvature of either the lower or upper bar 12 may be heightened and this way, under total pressure, exceed the force of the second concave surface. This excess causes a deflection beyond the usual goal of levelness of the feeder mouth 26 and permits adjustment to a curved application plane.

The distributor/feeder assemblies modified to operate within cylindrical carriers do not require the most elaborate steel sandwich since they are mostly supported along their total lateral extension, they do not exert very much operational pressure. Snaps, braces, springs replace some of the more massive structural elements used for heavier applications.

Since certain changes may be made in the above processes and devices without departing from the scope of the invention herein involved, it is intended that all matter contained in the above description or shown in the accompanying drawings shall be interpreted as illustrative and not in a limiting sense.

What I claim is:

1. A liquid distribution system comprising a plurality of liquid feeding chambers disposed successively along a horizontal line to apply liquid by gravity to an adjacent passing surface, said chambers including a plurality of vertical partitions separating said chambers into independent liquid feeding units, a plurality of separate liquid distribution cross channels positioned transversely in a horizontal row over said liquid feeding chambers, a plurality of liquid supply means supplying different liquids to respective said channels, a plurality of passageways connecting each said channel to each said chamber, and a plurality of detachable resilient liquid control means selectively insertable within said passageways, said control means including solid inserts to selectively block liquid flow and inserts having openings of different sizes to selectively limit liquid flow and permit full flow of liquid through said passageways to control the flow of liquids from said channels into said chambers.

2. The system of claim 1 including means for sensing liquid levels in each said channel to control liquid pressures.

3. The system of claim 2 wherein said inserts have openings of different cross sections and shapes to control the flow of liquid therethrough.

4. The system of claim 2 including means for equalizing distribution of liquid from said supply means throughout said channels.

5. The system of claim 2 including means for securing and pressure sealing said cross channels over said chambers.

6. The system of claim 2 wherein said channels include covers and air vent openings in said covers.

7. The system of claim 2 wherein said means for sensing liquid levels includes a sensor electrode positioned at a given liquid level to control the supply of liquid to said channel to maintain said given level.

8. The system of claim 7 wherein said electrode is of a semiconductor material having increased conductivity with the degree of immersion in said liquid.

9. The system of claim 2 wherein said means for sensing liquid levels includes a floating sensor.

10. The system of claim 2 wherein said chambers include a mouth section adjacent said passing surface, the bottom of said mouth section being raised above the bottom of said chambers.

* * * * *